United States Patent [19]

Fox

[11] Patent Number: 4,579,501

[45] Date of Patent: Apr. 1, 1986

[54] SYSTEM FOR HANDLING COMPRESSIBLE ARTICLES SUCH AS LOADED BAGS

[75] Inventor: Leonard S. Fox, Edmonton, Canada

[73] Assignee: Fiberglass Canada Inc., Toronto, Canada

[21] Appl. No.: 581,047

[22] Filed: Feb. 17, 1984

[30] Foreign Application Priority Data

Sep. 29, 1983 [CA] Canada ..... 437879
Dec. 20, 1983 [CA] Canada ..... 443726

[51] Int. Cl.[4] ..... B66F 9/18

[52] U.S. Cl. ..... 414/347; 414/622; 414/661

[58] Field of Search ..... 414/347, 619, 621, 622, 414/623, 661, 785; 294/67 AB

[56] References Cited

U.S. PATENT DOCUMENTS

| | | | |
|---|---|---|---|
| 2,388,458 | 11/1945 | Alfonte | 414/417 |
| 2,560,438 | 7/1951 | Gunn, Jr. | 414/621 |
| 2,808,157 | 10/1957 | Terrill | 414/347 |
| 2,841,302 | 7/1958 | Reisman et al. | 414/621 X |
| 2,869,742 | 1/1959 | Hileman | 414/622 |
| 2,950,830 | 8/1960 | Johnson | 414/622 |
| 3,174,639 | 3/1965 | Chase et al. | 414/621 |
| 3,266,645 | 8/1966 | McWilliams | 414/347 |
| 3,314,561 | 4/1967 | Chaney | 414/621 X |
| 3,450,288 | 6/1969 | Walsh | 414/621 X |
| 3,773,202 | 11/1973 | Dutra, Jr. | 414/622 |
| 3,788,496 | 1/1974 | Webb et al. | 414/39 |
| 3,788,507 | 1/1974 | Voss | 414/607 |
| 3,971,584 | 7/1976 | Duncan | 294/88 |
| 4,284,384 | 8/1981 | Olson | 414/434 |

FOREIGN PATENT DOCUMENTS

| | | | |
|---|---|---|---|
| 1293045 | 4/1962 | France | 414/621 |
| 158460 | 11/1978 | Netherlands | 414/785 |
| 137821 | 9/1960 | U.S.S.R. | 414/621 |

*Primary Examiner*—Robert J. Spar
*Assistant Examiner*—Ken Muncy
*Attorney, Agent, or Firm*—Stevens, Davis, Miller & Mosher

[57] ABSTRACT

A system for handling a load of compressible items such as bags of glass fibre insulation includes a cart having a predetermined distance between its end walls but open on sides. A forklift truck is provided with upright side walls movable towards and away from each other, and with transverse telescoping members spanning the upper edges of the side walls, combined with fork elements in forming a generally rectangular load receiving compartment which corresponds to the generally rectangular load receiving compartment of the cart. When the load is lifted from the cart, the side walls can be actuated to contract the load by restricting the width of the load receiving compartment such as to allow the driving of the forklift truck into the cargo space of a tractor trailer or another suitable transport vehicle. The unloading from the forklift truck is effected by a pusher plate known per se. The advance in the art is in simplified structure of the equipment and in faster operation as the respective carts become available immediately upon the unloading of the load. The structure of the cart itself is also simplified.

10 Claims, 14 Drawing Figures

SYSTEM FOR HANDLING COMPRESSIBLE ARTICLES SUCH AS LOADED BAGS

BACKGROUND OF THE INVENTION

The present invention relates to a system for handling compressible articles. The system is designed particularly for use in loading relatively large volume bags of glass fibre insulation but is not limited to the use in such field. The system is particularly suitable for handling large numbers of bulky bags having uniform size and being compressible.

In different manufacturing fields, it is desired to conveniently and quickly load into a cargo container of a truck or the like a large number of loaded bags, the bags being arranged in tier fashion in several rows across the width of the cargo compartment of the truck, with the elongation of the bags following the elongation of the cargo compartment.

It is well known in the art of material handling that forklift trucks having a so called pusher are advantageous in that they allow a quick engagement with a cargo and a convenient unloading of the cargo from the forklift by actuating the pusher plate to move forwards of the truck thus removing the load from the forklift. An embodiment of such pusher plate is shown, for instance, in U.S. Pat. No. 2,388,458 issued Nov. 6, 1945 to J. R. Alfonte. Another patent which shows that the basic principle of a pusher plate is well established in the art is U.S. Pat. No. 3,788,507 issued Jan. 29, 1974 to H. Voss. U.S. Pat. No. 4,284,384 is another example of a pusher plate mechanism connected with a forklift mechanism. All of the above patents show that the pusher plate arrangement belongs to a common general knowledge and many embodiments thereof have long been used in the art.

It is also known to provide a load engaging and gripping apparatus having side walls which are operatively associated with suitable, usually hydraulic, mechanism which grips the sides of a load, whereupon the load can be lifted and pivoted about a longitudinal, normally generally horizontal axis to suitably manipulate the handled load. U.S. Pat. No. 3,971,584, issued July 27, 1976 to A. W. Duncan is one of many examples of such a load engaging and gripping apparatus. Another example of such apparatus which is adapted to engage a load such as an upwardly elongated box near the top thereof and at the bottom, is shown in U.S. Pat. No. 3,174,639, issued Mar. 23, 1965 to D. B. Chase et al.

It is also known from the art of handling loads that the problem of economically handling loads while placing same into the cargo compartment of a truck trailer or the like has long been the subject of research and development. Thus, U.S. Pat. No. 3,788,496, issued Jan. 29, 1974 to Webb et al. shows a method and apparatus in which cartons are assembled and loaded into a truck or a railway car. Briefly, the apparatus includes a turning mechanism in combination with a conveyor. The turning mechanism orients a plurality of cartons into unit stacks which are then assembled into tiers of stacks having predetermined size to fit a given cargo space. Mechanical means are then used for inserting the assembled stacks into available cargo space to make a tight fit. The disadvantage of this system, as compared with the present invention, is mainly seen in complexity of the overall arrangement as a special, separate mechanism is required to be place between a forklift truck and the cargo compartment, as best shown in FIG. 14 of the reference.

Another known prior art dealing with the problem of handling bagged articles, in this case bagged mail, is described in U.S. Pat. No. 3,266,645 issued Aug. 16, 1966 to J. E. McWilliams. In this arrangement, the system comprises a plurality of sideless carts, each cart having a platform and two upright end walls so dimensioned as to generally correspond to the width of the box-shaped cargo is a transport vehicle. The platform and the end walls fixedly secured to same are arranged to be lifted from the carriage of each respective cart by a forklift truck, whereupon the forklift truck brings the whole arrangement of the platform and side walls into the cargo compartment. The forklift truck is equipped with a pusher plate and when the load is brought within the cargo compartment, the pusher plate is used to unload the load of bags from the platform. Then the forklift truck removes the empty platform from the cargo truck and places same back onto the carriage of the cart and proceeds with lifting the platform of the next cart. This arrangement eliminates the need of an intermediate arrangement such as shown in the Webb et al patent referred to above. However, it also eliminates the advantage of the Webb et al arrangement, namely the sideways compression of the articles before their placement within the cargo compartment. Moreover, the handling is relatively cumbersome since the operator of the cart must follow a relatively complex cycle, namely that of pick up of the platform from a cart, delivery of the load into the cargo compartment, return back to the cart, and the deposit of the empty platform back onto the carriage of the cart.

SUMMARY OF THE INVENTION

It is an object of the invention to further advance the art of handling of bagged compressible load such as glass fibre insulation containing bags, mail bags or the like, by simplifying the handling of the articles during the loading procedures and by simultaneously eliminating at least some of the relatively expensive elements such as a removable platform, shown in a prior art.

In general terms, the present invention provides, in one aspect, a forklift mechanism for handling loads of compressible articles such as loaded bags of glass fibre insulation, mail or the like, comprising, in combination: load supporting means coplanar with a normally generally horizontal plane and including two side portions, a free end front portion and a rear portion adapted to become operatively associated with first displacement means for selective raising or lowering of the load supporting means; normally generally vertical pusher plate means of a generally rectangular configuration, including an upper, normally generally horizontal edge portion, a lower, normally generally horizontal edge portion and two normally generally vertical side edge portions, said edge portions of the pusher plate means being generally coincident with the contour of a load receiving compartment in a constricted state, said pusher plate means forming one limiting surface of the load receiving compartment and being operatively associated with second displacement means for selectively displacing the pusher plate means from a retracted position at which the pusher plate means is at the rear end of the fork members, to an extended position at which the pusher plate means is disposed at the free end of the load supporting means; a pair of normally generally vertical side plate means at the side portions of the load supporting means, said vertical side plate means being operatively associated with a third displacement means for selectively displacing the side plate means transversely of the load supporting means towards each other and away from each other to assume a contracted terminal state wherein the distance between the side plate means is at a minimum, and an expanded state, wherein said distance is at a maximum; and transverse top limiting means extending between normally upper portions of said side plate means and defining an upper limit of a load receiving compartment having a generally rectangular configuration, the sides of said load receiving compartment being defined by said side plate means and the bottom thereof by said load supporting means.

Preferably, the side plate means extends generally the entire height of the load receiving space. It is also preferred that the transverse top limiting means include telescopic rod means whose opposed ends are secured to the respective side plate means near the upper edge portions thereof.

In another aspect, the present invention provides a system for loading loads of compressible articles such as bags or glass fibre insulation, mail or the like, into a box-shaped, generally rectangular cargo compartment of a transport vehicle, said compartment of a transport vehicle having a predetermined width, said system comprising: forklift means mounted on a motor driven vehicle and including load supporting means, preferably of the type including an assembly of fork members disposed in a side-by-side fashion in a row and coplanar with a normally generally horizontal plane, said fork members being operatively associated with first displacement means adapted to selectively raise or lower the fork member assembly; normally generally vertical pusher plate means of a generally rectangular configuration, including an upper, normally generally horizontal edge portion, a lower, normally generally horizontal edge portion and two normally generally vertical side edge portions, said edge portions of the pusher plate means being generally coincident with the contour of a load receiving compartment in a constricted state, said pusher plate means being operatively associated with second displacement means for selectively displacing the pusher plate means from a retracted position at which the pusher plate means is at root ends of the fork member, to an extended position at which the pusher plate means is disposed at free end tips of the fork members; a pair of normally generally vertical side plate means at opposed sides of the assembly of fork members, said vertical side plate means being operatively associated with a third displacement means for selectively displacing the side plate means transversely of the fork member assembly towards each other and away from each other to assume a contracted terminal state wherein the distance between the side plate means is at a minimum, and an expanded state, wherein said distance is at a maximum; and transverse top limiting means extending between normally upper portions of said plate means and forming an upper limit of a load receiving compartment having a generally rectangular configuration and defined, at a rear end, by the pusher plate means at the sides, by said side plate means and, at the bottom, by said assembly of the forklift members; a plurality of side-less carts, each cart including: a generally rectangular platform having two opposed end retainer means disposed generally vertically and protruding upwards at respective ends of the platform; the spacing between the end retainer means being so dimensioned that said plate means can be placed exteriorly of and closely spaced from said end retainer means to allow free vertical movement of the side plate means relative to the end retainer means at a close spacing therefrom when said distance between the side plate means is at its maximum, the corresponding inner spacing between the side plate means at the constricted state being less than that of the spacing between said end retainer means and the width of said side plate means at outer surfaces thereof being less than said predetermined width of said generally rectangular cargo compartment of a respective transport vehicle with which the system is to be used, the height of the load receiving compartment of said forklift means being less than the height of said cargo compartment.

BRIEF DESCRIPTION OF THE DRAWINGS

The invention will now be described by way of a preferred embodiment with reference to the accompanying drawings which show the principles of the invention in a diagrammatic way, it being understood that the particular elements of the combination of the present invention are well known in the art and can be substituted by many alternatives without departing from the scope of the present invention.

In the drawings.

DESCRIPTION OF PREFERRED EMBODIMENTS

Figure 1:
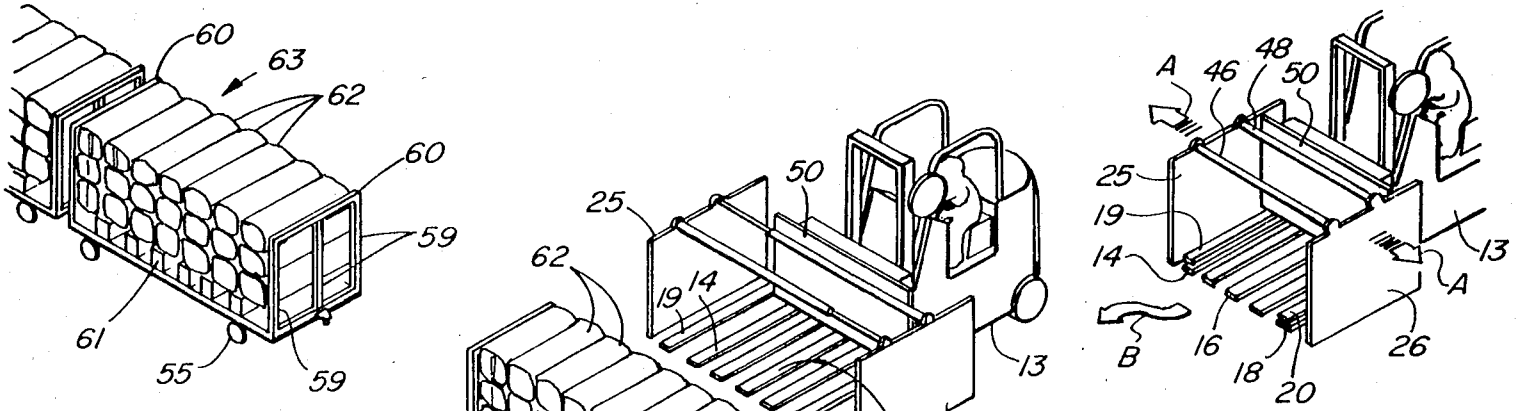
FIG. 1 is a diagrammatic representation of a cart loaded with bags of glass fiber insulation.

Turning firstly to the representations of FIGS. 8–12, a forklift truck 13 is provided with load supporting means. The embodiments shown in the drawings use load supporting means of the type of a forklift mechanism which per se is well known and which includes a plurality of intermediate fork members 14, 15, 16, 17 and 18. As is well known in the art of forklift trucks, the fork members 14–18 are disposed in a generally horizontal row and are associated with a suitable hydraulic mechanism, such as hydraulic cylinders 18A, 18B shown in FIG. 12, also referred to as "fork displacement means" for lifting and lowering of the row of the fork members 14–18. A mechanism for slightly inclining the row of fork members 14–18 from the generally horizontal position also forms a part of any standard forklift truck and therefore does not have to be described in detail. The "fork displacement means" is so arranged and disposed that it lifts or lowers not only the fork members but also the remaining parts described hereinafter and forming a load receiving compartment. At the left-hand side of the view of FIG. 8, a side fork member 19 is shown and to the right-hand side of the same figure the opposite side fork member 20 is indicated. As best seen from FIG. 11, each side fork member is of a generally L-shaped cross-sectional configuration and has a normally downwardly elongated rib section 21 and a horizontally elongated top section 22. The arrangement of the opposite side fork member 20 is a mirror image of that of the side fork member 19.

Figure 10:
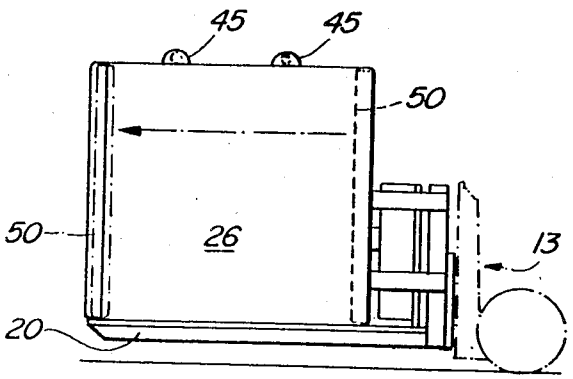
FIG. 10 is a diagrammatic side view, indicating the movement of the pusher plate during the unloading the bags from the forklift.
Figure 8:
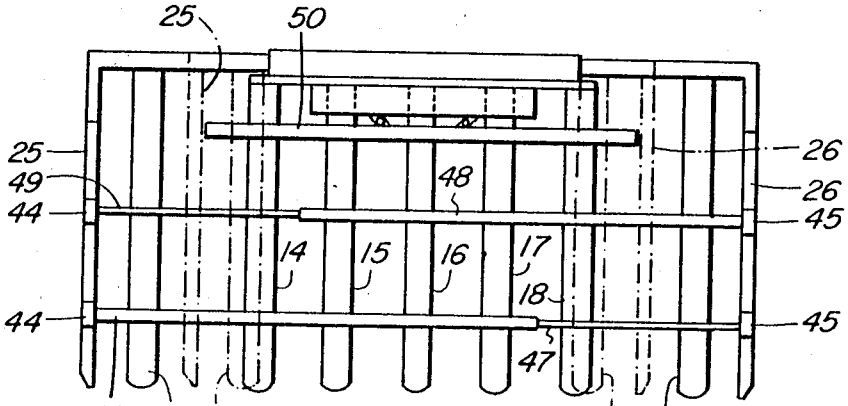
FIG. 8 is a simplified, diagrammatic top plan view of the forklift assembly showing the mutual arrangement in a fully expanded and fully contracted state, to indicate the mutual arrangement of the side walls (also referred to as "side plate means") and of the forklift members at the two stages.
Figure 9:
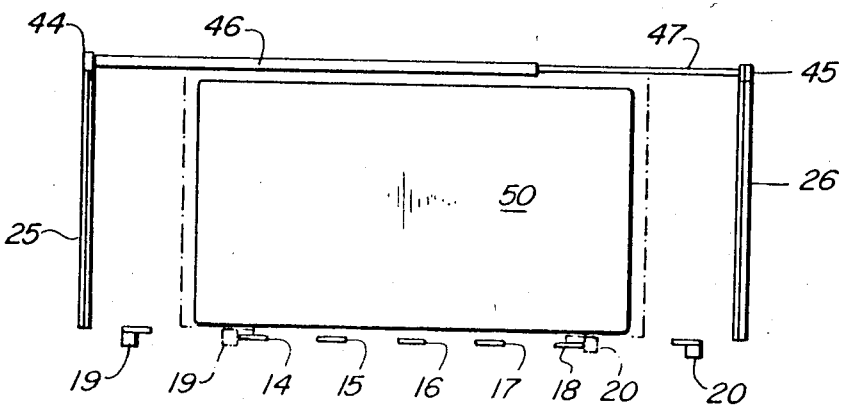
FIG. 9 is a simplified, diagrammatic end view of what is shown in FIG. 8, indicating the contracted state of the load receiving compartment of the forklift.
Figure 11:
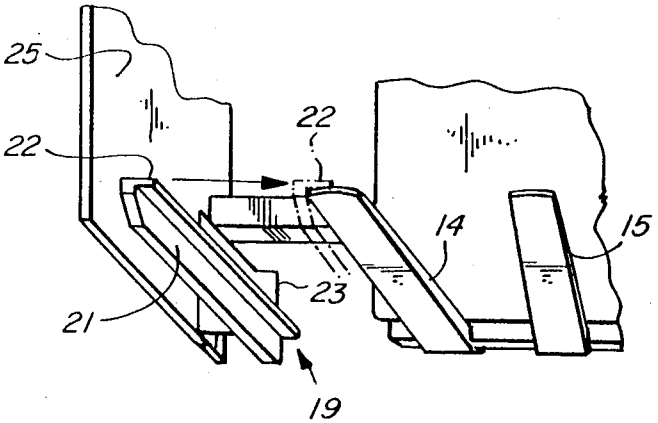
FIG. 11 is a simplified, diagrammatic representation showing one extreme side forklift member and its arrangement with respect to the remaining forklift members of the assembly.
Figure 12:
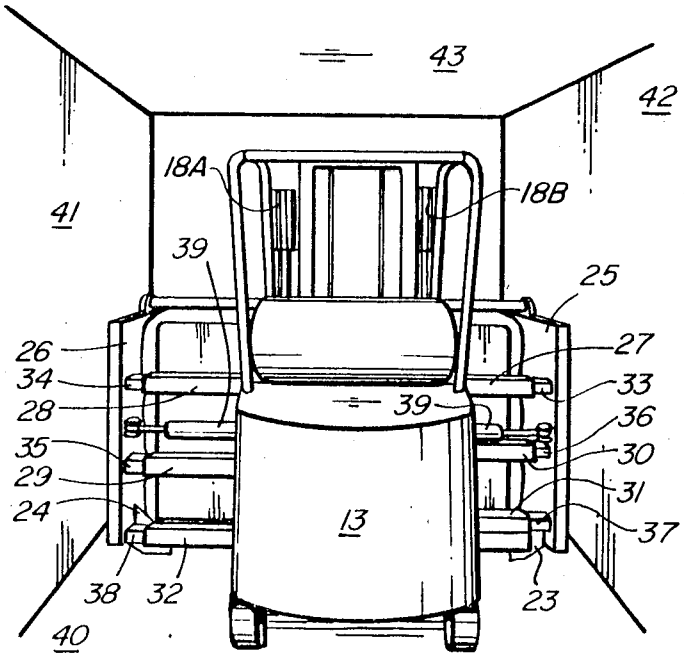
FIG. 12 is a simplified, rear perspective view of a forklift truck generally as shown in the position of FIG. 7 but indicating, in a diagrammatic way, the mutual position of the elements holding the side walls in their operative positions.

As indicated in FIG. 11, each side fork member 19 is fixedly secured to a support plate 23, the support plate of the opposite side fork member 20 being indicated only diagrammatically and referred to with reference number 24 in FIG. 12. FIGS. 8, 9 and 10 do not show the support plates 23, 24 for the sake of simplicity.

The support plate 23 fixedly secures the associated side fork member 19 to a respective side wall 25 such as to maintain the side fork member 19 at a predetermined spaced parallel relationship with the side wall 25, as best shown in FIG. 8. The opposite support plate 24 retains in a similar fixed relationship the side fork member 20 and the second side wall 26.

As is well known in the art of forklift trucks, the side walls 26, 25 can be suitably reinforced at their exterior. It is preferred, however, that their inner surface be generally planar and smooth and that it extend the entire height of the load receiving compartment of the forklift truck as will be referred to hereinafter. To the forklift truck is secured a series of horizontal sleeve members, 27, 28, 29, 30, 31 and 32 (FIG. 12). Each sleeve member is of a square cross-sectional configuration and is adapted to slidably and telescopically receive a complementary rod 33, 34, 35, 36, 37 and 38. Each of the rods 33–38 is fixedly secured, for instance by welding, to one of the side plates 25, 26, as is seen from FIG. 12. A hydraulic cylinder 39 extends across the front end of the forklift carriage and is secured with its piston rods, one at each end, to the respective side walls 25, 26. The cylinder 39 thus forms means, known per se and referred to as "side plate displacement means" for selectively displacing the side plate means or side plates 25, 26 from an expanded position (full lines in FIGS. 8 and 9) to a contracted position (broken lines of FIGS. 8 and 9). The contracted position is also shown in FIG. 12 as corresponding in width to the width of a cargo compartment of a truck, formed by a floor 40, two opposed side walls 41, 42, and a ceiling 43. It is shown in FIG. 8 and also in FIG. 11, that the side fork members 19, 20 partly overlap the adjacent fork members 14, 18, respectively, when the contracted state is reached.

Each of the side walls 25, 26 of the forklift mechanism is provided, near its top edge, with an upwardly arched, rounded bracket. The brackets of the side walls 25, 26 are referred to with reference numerals 44, 45, respectivey. The brackets 45 and 44 are thus generally coincident with the plane defined by the top, normally generally horizontal edges of the side walls 25, 26. Fixedly secured to the forward bracket 44 is a sleeve 46 within which is telescopically received a rod 47 whose one end is fixedly secured to the forward bracket 45 of the side wall 26. In a similar fashion, the rear bracket 45 of the side wall 26 supports a sleeve 48 within which is telescopically received a rod 49 fixedly secured to the rear bracket 44 of the side wall 25. The sleeves and rods 46–49 thus form a telescopic assembly defining the upper limit of the load receiving compartment of the forklift, as can be seen, for instance, in FIG. 3.

Figures 4, 5, 6:
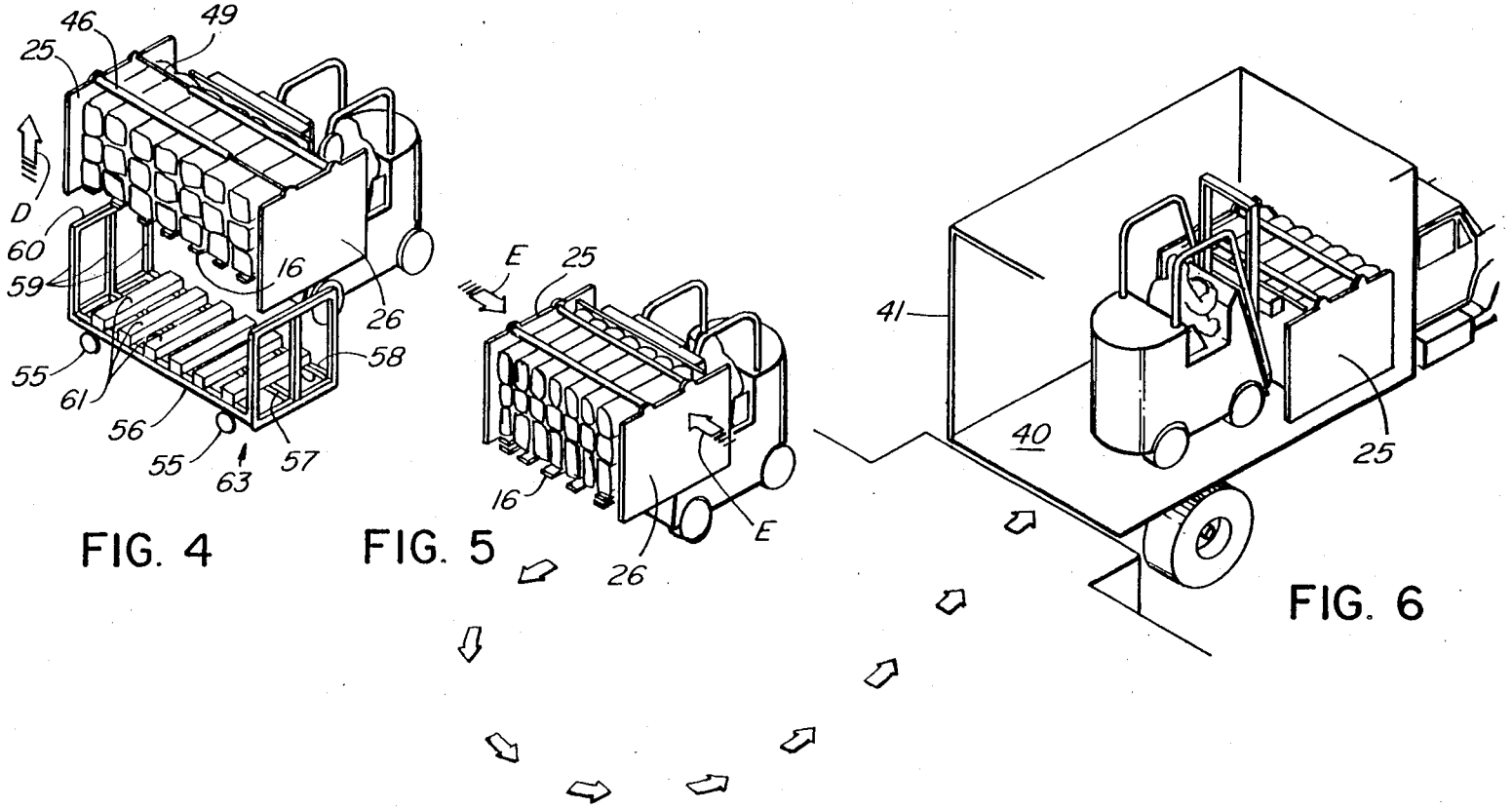
FIG. 4 shows the next stage at which the load of bags is lifted from the cart.
FIG. 5 represents diagrammatic representation of the next stage at which the side walls of the forklift have been actuated to compress the load.
FIG. 6 shows the forklift truck of FIG. 5 within the cargo compartment of a transport truck at the beginning of the unloading stage.

It will be appreciated that the sleeves and rods 46–49 enclosing the loading space on top, serve the purpose of preventing the load or its upper part from arching upwardly on compression or contraction state such as shown in FIG. 5.

The normally rear end of the load receiving compartment is limited by a rectangular pusher plate 50 which is shown in the drawings as being a solid, flat, smooth plate even though it will be appreciated that it can be provided with suitable cutouts or the like to reduce the weight thereof.

As is well known in the art, the pusher plate 50 can assume a retracted position (to the right of FIG. 10) in which it is virtually coincident with the root ends of the fork members 14–18. The second extreme position is also shown in FIG. 10, to the left thereof and shows that the pusher plate 50 generally coincides with the free tips of the fork members 14–18.

Thus, the side walls 25, 26, the fork members 14–18 and 19–20, the telescopic sleeves and rods 46–49 combine to define between themselves a load receiving compartment which is raised and lowered together with the fork members. The load receiving compartment is of a generally rectangular configuration. It can be contracted from an expanded state (full lines of FIG. 9) to a constricted state which generally corresponds to the contour of the pusher plate 50 (FIG. 9).

Figure 7:
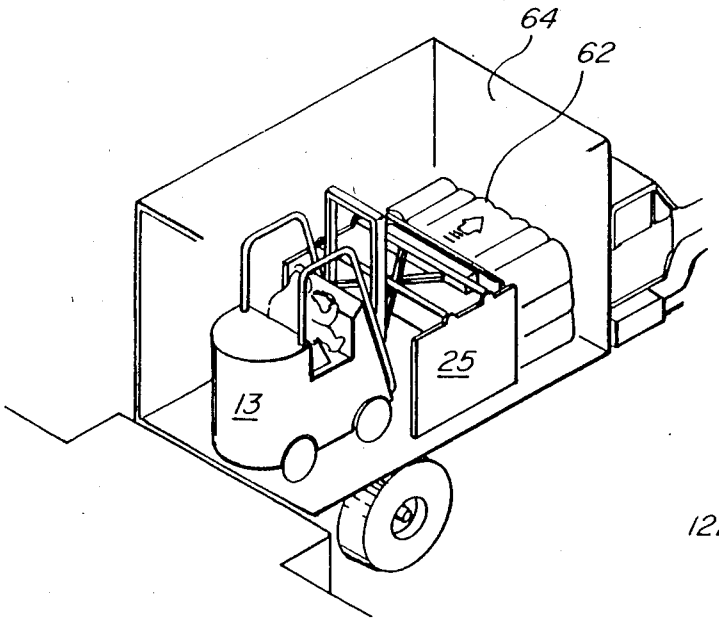
FIG. 7 is a view similar to FIG. 6 but showing the next stage, namely the unloading of the bags from the forklift truck and the depositing of same in the cargo compartment.

The forklift truck is capable of carrying out selected movements of its elements defining the load receiving compartment in several directions. First, as already mentioned, the entire assembly can be lifted up and down as indicated by the arrow in FIG. 4. Second, the side walls 25, 26 can be moved towards each other (arrows in FIG. 5) and away from each other (arrows in FIG. 2). Finally, the pusher can be moved from retracted position (FIG. 2) to an extended position (FIG. 7 or left hand side of FIG. 10). The height of the load receiving compartment remains unchanged and is limited at the bottom by the system of the fork members 14–18 and on top by the telescopic sleeves and rods 46–49. Preferably, the height of the space generally corresponds to the height of the side plates 25, 26.

The system of the present invention further includes a cart whose structural features are best seen from the diagrammatic representation of FIG. 4. The truck includes four wheels 55 supporting a platform section which is formed by elongated beams 56, 57 and 58. The sides of the platform are open and each end thereof is enclosed by an upright structure, also referred to as "end retainer means". Each upright structure is formed by three upright beams such as beams 59 shown to the left of FIG. 4 whose upper ends are connected with transverse member 60. The whole assembly of the beams 56–60 is welded together to form a rugged, generally U-shaped structure which is open sided and has two upright end wall members. The platform formed by the beams 56–58 is provided with a plurality of spacers 61 which are of rectangular cross-sectional configuration and are sufficient in height and width to receive the respective fork members 13–20 when the side walls of the fork lift truck mechanism are in the expanded state. FIG. 1 shows the cart loaded with a plurality of bags 62 containing glass fibre insulation. The spacing of the rods or spacers 61 (and of the fork members 14–20) is so selected that the bags 62 are at least partly supported by at least one of the fork members 14–20 when the forklift mechanism is in its expanded state.

Referring now to FIGS. 1–6, FIG. 1 shows the state at which the cart 63 has been loaded with the bags 62 and is on its way to a station at which it is to be picked up by the forklift.

Figure 2:
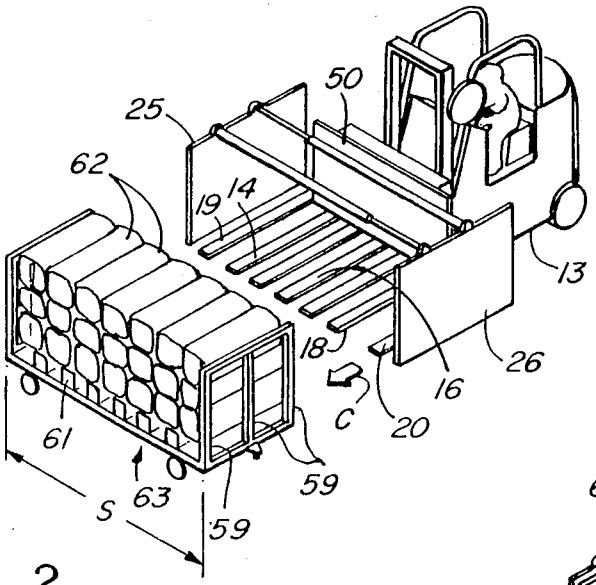
FIG. 2 is a diagrammatic representation showing the next step according to the present invention, namely a forklift truck approaching the cart for lifting the load therefrom.
Figure 3:
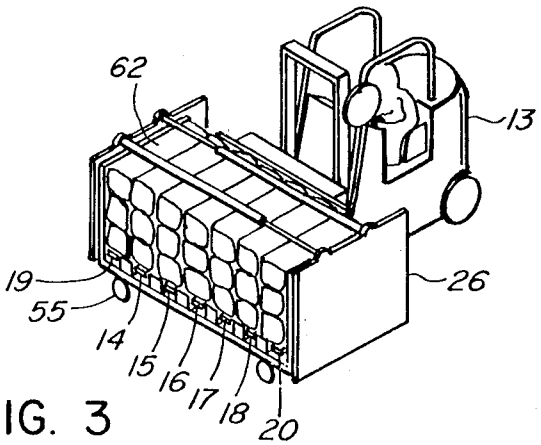
FIG. 3 is a diagrammatic representation of the next stage with the forklift truck shown in engagement with the load on the cart, ready to began the lifting of the load off the cart.

In FIG. 2, a forklift truck 13, arriving from the transport truck cargo space has the side walls 25, 26 in a contracted state. The side walls 25, 26 are moved each in the direction of arrow A from a contracted state shown to the upper right of FIG. 2, to a fully extended state which is shown in the centre of FIG. 2. This is done by the acuation of the "third displacement means" referred to above. Note that in the contracted state, the side fork members 19, 20 partly overlap the adjacent fork members 14, 18, respectively. The forklift truck is driven (arrow B) to face one side of the cart 63 such that the respective fork members 14–20 may enter, on driving the truck in direction C, into the spaces between the bars or spacers 61. At the end of this step, the forklift truck 13 eventually assumes the position shown in FIG. 3, at which the free end tips of forklift members 14–20 are shown as being disposed in the respective spaces at the other side of the cart. FIG. 3 also shows that the side walls 25, 26, when assuming the extended position (the state at the center of FIG. 2) are spaced apart a distance which is slightly more than the outside spacing S (FIG. 2) of the end retainer means formed by the beams 59, 60. Accordingly, the side walls 25, 26 can envelope the end retainer means 59, 60 from outside, with the fork members 14–20 engaging at least partly each of the bags 62 at the lower most layer of the load.

The subsequent actuation of the "fork displacement means" results in elevation of the fork members 14–20 in the direction D shown in FIG. 4. Again, it is noteworthy from FIG. 4 that all of the bags are supported by at least a part of at least one of the fork members 14–20.

As soon as the load clears the cart 63, the "side plate displacement means" is again actuated to move the side walls 25, 26 in the direction E (FIG. 5) to bring the load receiving compartment to a contracted state which is shown in a somewhat exagerated, out-of-scale fashion at FIG. 5. The contracted state roughly corresponds to the arrangement visible in FIG. 12. In this arrangement, the spacing between the outside surfaces of the side walls 25, 26 is such that with the forklift truck entering the cargo space formed by the floor 40, and side walls 41, 42 there is a clearance between the outer surface of the side walls 25, 26 and the respective side walls 41, 42 of the cargo space. Subsequently, the pusher plate 50 is actuated by a second displacement means to bring same from a retracted position (to the right of FIG. 10) to an extended position (to the left of FIG. 10). This results in the discharge of the bags 62 towards a face wall 64 of the cargo compartment. The forklift truck 13 is simultaneously being backed towards the rear end of the truck.

A number of modifications can be effected within the scope of the present invention. One such change is shown in FIG. 13.

In certain applications it may be desirable to increase the number of bags which the device is capable of handling. Such modification is useful particularly when loads such as bags of glass fiber or the like are involved, in which a temporary compression of the bags does not pose any problem from the standpoint of damaging the contents of the bag.

In order to increase the capacity of the device, it is necessary to allow a wider span between the side walls of the forklift mechanism while at the same time allowing for a compression dictated by the width of the truck or the like, the second, compressed state being more or less constant. In other words, in some instances it is desired that the difference between the side walls at their maximum span and at their minimum span be greater than with the device of the first embodiment described above.

Figure 13:
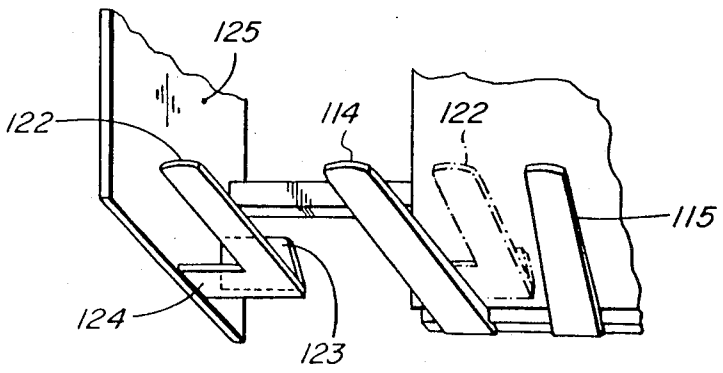
FIG. 13 (on the sheet of FIG. 7) is a simplified, diagrammatic representation similar to FIG. 11 but showing a modification of the device.

In such case, it is within the scope of the present invention to provide a modification as shown in FIG. 13. In this embodiment, the actual number of the forklift members corresponding to forklift members 14 and 15 is increased (the increase not being apparent in FIG. 13 since it only shows a partial view). The basic modification is effected in the area of the side fork members. Reference numeral 125 of FIG. 13 shows a counterpart of side wall 25 of FIG. 11. It will be seen from FIG. 13 that the side fork member 122 is of a flat configuration generally corresponding to the configuration of forklift members 114, 115. The level of the forklift member 22 is such that it can pass over the forklift member 114. The forklift member 122 is of a generally L-shaped contour when viewed in a plan view and is provided at its rear end with a gusset 123. Reference number 124 designates a rear arm of the forklift member which is flat and is generally co-planar with the remaining part of the forklift member 122. The gusset 123 is upright and reinforces the joint at which the forklift member 122 is secured to the side wall 125. It will be appreciated that with this embodiment, the forklift member 122 can be more substantially spaced from its associated side wall 125. Moreover, as shown in broken lines, the forklift member 122 is now capable of passing over the adjacent "stationary" forklift member 114 into a space between the two "stationary" forklift members 114, 115. Thus, the overall difference between the maximum and minimum width between the side walls of the forklift is increased. If necessary, the associated hydraulic and guide systems of the side walls can be modified to accommodate the increased difference between the maximum and minimum width of the device. Such modifications, however, do not add anything to the teachings of the present invention and are obvious to those skilled in the art. Therefore, there is no need to describe details of such arrangement. Naturally, the configuration of an associated cart would also be changed to accommodate the modified arrangement of the forklift members as referred to.

In certain applications of the present invention, it may be desirable that the space limited by the clamping side walls, by fork members and by the transverse telescopic rods 46, 47, 48 and 49 expand and contract not only sideways but also in vertical direction, in order to facilitate the engagement of the load by the forklift mechanism and the handling of the load within compartments whose height may be limited.

Figure 14:
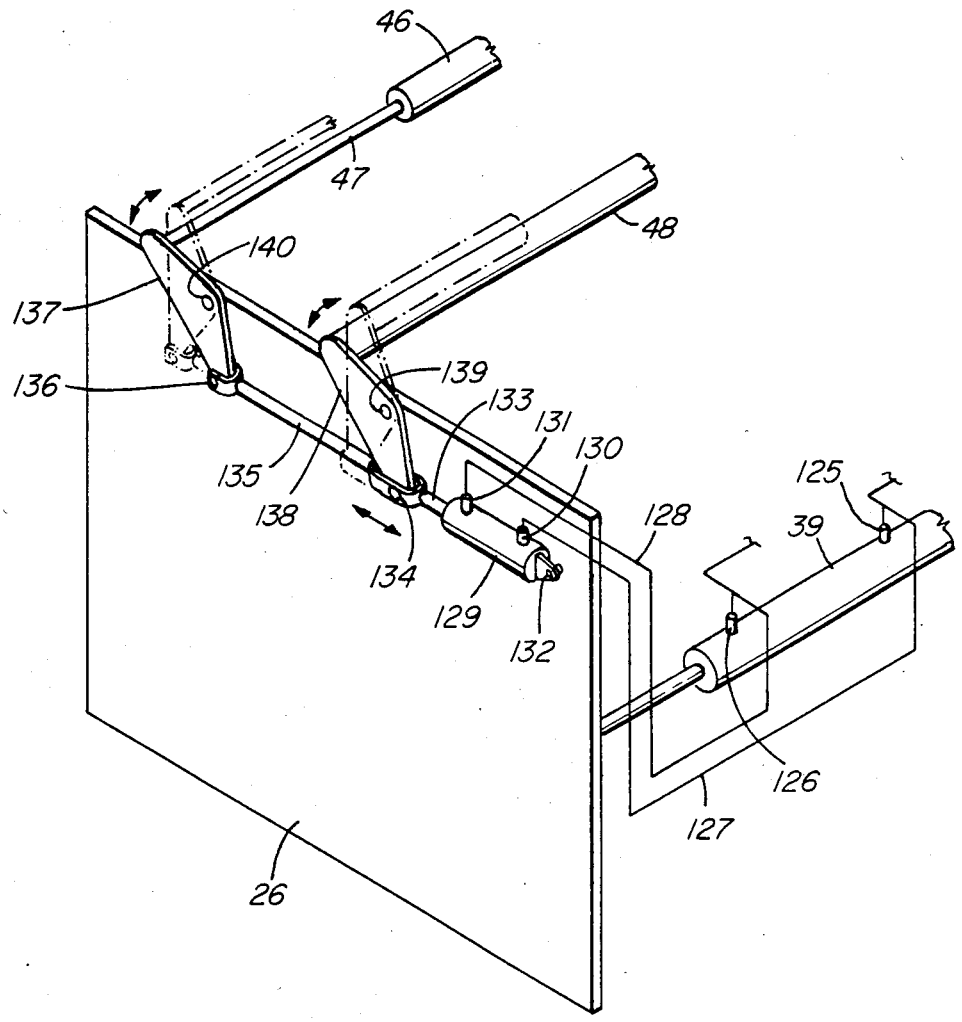
FIG. 14 a diagrammatic representation of an improvement of the basic arrangement shown in the preceding drawings.

One of many embodiments by which the above arrangement can be achieved is shown in FIG. 14. This drawing is a simplified diagrammatic representation of the operative association of the preferred mechanism of this type with the hydraulic cylinder 39 used in expanding or contracting the side walls 25, 26. The side wall 26 is shown as being connected to the left-hand side hydraulic cylinder 39. The hydraulic cylinder 39 includes two joints 125, 126 for conveying hydraulic fluid, it being understood that the joints alternate as inlets and outlets depending on the instant mode of operation. The joint 125 is normally disposed at the face of a cylinder operating the left-hand piston rod of the piston 39. On the other hand, the joint 126 is disposed at a location which is at the opposite face of the piston of cylinder 39, as is well known in the art. Accordingly, if hydraulic fluid is caused to flow from a hydraulic hose 127, over the joint 125 into the cylinder 39, the piston rod moves to the left of FIG. 14, in an expanding movement of the side wall 26. At the same time, the hydraulic fluid from within the cylinder 39 is drained, via line 128 (which is now a bleeding line) to a sump or the like. Conversely, if pressurized hydraulic fluid is brought through the line 128, the piston within cylinder 39 contracts the side wall 26. As seen from FIG. 14, each of the lines 127 and 128 is also operatively associated with a hydraulic cylinder 129. The line 127 enters cylinder 129 at 130. The line 128 communicates with the cylinder 129 at 131. The cylinder 129 is pivotally secured to the side wall 26 at 132. A piston rod 133 of the cylinder 129 is pivotally secured, at 134, with one end of a connecting rod 135 whose opposite end is pivotally secured, at 136, with a bell crank 137, the first-mentioned pivot 134 also securing the piston rod 133 to a bell crank 138. The bell cranks 138 and 137 are pivotally secured to the side wall 26 at pivots 139 and 140. The portions of bell cranks 138, 137 remote from pivots 134, 136, are fixedly secured to the respective transverse telescopic rods 46–47; and 48–49 (only the sleeve portion 48 being shown of the latter).

The opposite side wall 25 is provided with an arrangement which is identical and therefore is not shown in the drawing of FIG. 14. It will thus be appreciated that the actuation of a suitable control valve (not shown) directed to bring pressurized hydraulic fuel into line 127 and to bleed hydraulic line 128 will result not only in the expansion of the hydraulic cylinder 39 but also in the expansion of hydraulic cylinder 129 with the result being extension of the piston rod 133 to a position generally as shown in broken lines of FIG. 14. The reversed flow of hydraulic fluid through lines 127 and 128 will result in a contracting movement of the hydraulic cylinders 39 and 129. The latter will also cause both bell cranks 138, 137 to turn counterclockwise thus lowering the level of the transverse rods 46, 47, 48 to a level generally corresponding to the level of the top edge of the side wall 26, as shown in full lines of FIG. 14.

Thus, the operation of the "third displacement means" as referred to at the outset will also result in expansion of the clearance defined by the forklift mechanism of the present invention in vertical direction, to facilitate the engagement of a load such as a series of glass fibre insulation containing bags.

In a further obvious modification of the embodiment of FIG. 14, the forward assembly of transverse rods 46–47 can be eliminated thus simplifying the overall structure. In this modification, the elements of the connecting rod 135, the yoke 136, the second bell crank 137 and the pivot 140 are not required.

Those skilled in the art will appreciate that the present invention provides a substantial simplification, both structurally and from the standpoint of operation, over what is known in prior art discussed above.

Those skilled in the art will also appreciate that the elements of the apparatus of the present invention, for instance, the load supporting means, are available in many different forms and operational structures. Accordingly, many modifications of the preferred embodiment may be done without departing from the present invention as recited in the accompanying claims.

I claim:

1. A forklift mechanism including a load receiving compartment for handling loads of compressible articles such as loaded bags of glass fibre insulation, mail or the like, comprising, in combination:

(a) load supporting means coplanar with a normally generally horizontal plane and including two side portions, a free end front portion and a rear portion, said load supporting means being adapted to become operatively associated with fork displacement means for selective raising or lowering of the load supporting means, whereby the load supporting means is capable of becoming inserted under a load and of raising or lowering the load;

(b) normally generally vertical pusher plate means of a generally rectangular configuration, including an upper, normally generally horizontal edge portion, a lower, normally generally horizontal edge portion and two normally generally vertical side edge portions, said edge portions of the pusher plate means being generally coincident with the contour of a load receiving compartment in a constricted state, said pusher plate means forming one limiting surface of the load receiving compartment and being selectively displaceable from a retracted position at which the pusher plate means is at the rear end of the fork members, to an extended position at which the pusher plate means is disposed at the free end portion of the load supporting means;

(c) a pair of normally generally vertical side plate means at the side portions of the load supporting means, said vertical side plate means being operatively associated with side plate displacement means for selectively displacing the side plate means transversely of a portion of the load supporting means towards each other and away from each other to selectively assume a contracted terminal state wherein the distance between the side plate means is at a minimum, and an expanded state, wherein said distance is at a maximum;

(d) said load supporting means being formed by a fork member assembly including a plurality of generally uniformly spaced-apart, longitudinally and generally horizontally elongated fork members comprising transversely movable extreme side fork members and transversely stationary intermediate fork members;

(e) transverse top limiting means extending between normally upper portions of said side plate means and defining an upper limit of the load receiving compartment having a generally rectangular configuration, the sides of said load receiving compartment being defined by said side plate means, the bottom of the compartment being formed by said load supporting means;

(f) said pusher plate means, said side plate means and said top limiting means being so associated with said load supporting means that the entire load receiving compartment is raised or lowered on actuation of said fork displacement means.

2. A forklift mechanism as claimed in claim 1, wherein the transverse top limiting means includes telescopic rod means whose opposed ends are secured to the respective side plate means near the upper edge portions thereof and at points disposed between first and rear ends of each upper edge portion.

3. A forklift mechanism as claimed in claim 1, wherein the load supporting means is a fork member assembly including a system of a plurality of transversely stationary fork members, an extreme side fork member at each side of said load receiving compartment, each extreme side fork member being fixedly secured to the side plate means at the respective side and thus being transversely displaceable therewith, each extreme side fork member being so arranged and dimensioned that when the side plate means assume the expanded state, the side fork members form said side portions of the load supporting means.

4. A forklift mechanism as claimed in claim 2, wherein the transverse top limiting means is secured to each of said side plate means by way of a mounting arrangement adapted to raise the transverse top limiting means when the side plates are at said expanded state, and to lower same when the side plates are in or about to assume the contracted terminal state.

5. A forklift mechanism as claimed in claim 4, wherein said mounting arrangement includes a hydraulic motor means at each side plate means, each motor means being operatively connected by a hydraulic conduit with hydraulic conduits of a hydraulic cylinder included in said side plate displacement means such that the actuation of the side plate displacement means results in a respective actuation of the hydraulic motor means.

6. A system for loading loads of compressible articles such as bags of glass fibre insulation, mail or the like, into a box-shaped, generally rectangular cargo compartment of a transport vehicle, said compartment having a predetermined width, said system comprising:

(A) forklift means mounted on a motor driven vehicle and including:

(a) load supporting means coplanar with a normally generally horizontal plane and including two side portions, a free end front portion and a rear portion operatively associated with fork displacement means for selectively raising or lowering of the load supporting means, whereby the load supporting means is capable of becoming inserted under a load and of raising or lowering the load;

(b) normally generally vertical pusher plate means of a generally rectangular configuration, including an upper, normally generally horizontal edge portion, a lower normally generally horizontal edge portion and two normally generally vertical side edge portions, said edge portions of the pusher plate means being generally coincident with the contour of a load receiving compartment in a constricted state, said pusher plate means forming one limiting surface of a load receiving compartment and being selectively displaceable from a retracted position at which the pusher plate means is at the rear portion of the load supporting means, to an extended position at which the pusher plate means is disposed at the free end front portion of the load supporting means;

(c) a pair of normally generally vertical side plate means at the side portions of the load supporting means, said vertical side plate means being operatively associated with a side plate displacement means for selectively displacing the side plate means transversely of a portion of the load supporting means towards each other and away from each other to selectively assume a contracted terminal state wherein the distance between the side plate means is at a minimum, and an expanded state, wherein said distance is at a maximum;

(d) said load supporting means being formed by a fork member assembly including a plurality of generally uniformly spaced apart, longitudinally and generally horizontally elongated fork members comprising transversely movable extreme side fork members and transversely stationary intermediate fork members;

(e) transverse top limiting means extending between normally upper portions of said side plate means and defining an upper limit of the load receiving compartment having a generally rectangular configuration, the sides of said load receiving compartment being defined by said side plate means, the bottom of the compartment being formed by said load supporting means;

(f) said pusher plate means, said side plate means and said top limiting means being so associated with said load supporting means that the entire load receiving compartment is raised or lowered on actuation of said fork displacement means;

(B) a plurality of sideless carts, each cart including:

(a) a generally rectangular platform having two opposed end retainer means disposed generally vertically and protruding upwards at respective ends of the platform;

(b) the spacing between the end retainer means being so dimensioned that said side plate means can be placed exteriorly of and closely spaced from said end retainer means to allow free vertical movement of the side plate means relative to the end retainer means at a close spacing therefrom when said distance between the side plate means is at its maximum, and, when said distance between the side plate means is at its minimum, the corresponding inner spacing between the side plate means is less than the inner spacing between said end retainer means, the outer spacing between said side plate means as measured at outer surfaces of the side plate means being less than said predetermined width of the generally rectangular cargo compartment of a transport vehicle with which the system is to be used, the height of the load receiving compartment of said forklift means being less than the height of said cargo compartment.

7. A system as claimed in claim 6, wherein the transverse top limiting means includes telescopic rod means whose opposed ends are secured to the respective side plate means near the upper edge portions thereof at points disposed between front and rear ends of each upper edge portion.

8. A system as claimed in claim 6, wherein the load supporting means is a fork member assembly including an extreme side fork member at each side of said load receiving space, each extreme side fork member being fixedly secured to the side plate means at the respective side and thus transversely displaceable therewith.

9. A forklift mechanism as claimed in claim 7, wherein the transverse top limiting means is secured to each of said side plate means by way of a mounting arrangement adapted to raise the transverse top limiting means when the side plates are at said expanded state, and to lower same when the side plates are in or about to assume the contracted terminal state.

10. A forklift mechanism as claimed in claim 9, wherein said mounting arrangement includes a hydraulic motor means at each side plate means, each motor means being operatively connected by a hydraulic conduit with hydraulic conduits of a hydraulic cylinder included in said third displacement means such that the actuation of the third displacement means results in a respective actuation of the hydraulic motor means.

* * * * *